US011241881B2

(12) United States Patent
Eto

(10) Patent No.: US 11,241,881 B2
(45) Date of Patent: Feb. 8, 2022

(54) LIQUID EJECTION APPARATUS AND INKJET RECORDING APPARATUS CAPABLE OF COOLING A CONTROL BOARD OF A LIQUID EJECTION HEAD WITHOUT COOLING A LIQUID SUPPLY PATH

(71) Applicant: KYOCERA Document Solutions Inc., Osaka (JP)

(72) Inventor: Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/109,926

(22) Filed: Dec. 2, 2020

(65) Prior Publication Data

US 2021/0162751 A1 Jun. 3, 2021

(30) Foreign Application Priority Data

Dec. 2, 2019 (JP) ..... JP2019-217780

(51) Int. Cl.
*B41J 2/14* (2006.01)

(52) U.S. Cl.
CPC ..... *B41J 2/1408* (2013.01); *B41J 2/14314* (2013.01); *B41J 2202/08* (2013.01)

(58) Field of Classification Search
CPC .... B41J 2/0454; B41J 29/377; B41J 2202/08; B41J 2/1408; B41J 2/14314; B41J 2202/20; B41J 29/38; B41J 2/175; B41J 2/01; B41J 2/14; B41J 2/04553; B41J 2/04563
See application file for complete search history.

(56) References Cited

U.S. PATENT DOCUMENTS

2016/0297221 A1 10/2016 Kitazawa et al.
2019/0322107 A1* 10/2019 Ozawa ..... B41J 2/01
2019/0343106 A1* 11/2019 Okazaki ..... B41J 2/16508
2020/0130350 A1* 4/2020 Hara ..... B41J 11/00222

FOREIGN PATENT DOCUMENTS

JP 2016-198926 A 12/2016

* cited by examiner

*Primary Examiner* — Kristal Feggins
(74) *Attorney, Agent, or Firm* — Hawaii Patent Services; Nathaniel K. Fedde; Kenton N. Fedde

(57) ABSTRACT

Provided is a liquid ejection apparatus capable of cooling a control board of a liquid ejection head without cooling a liquid supply path. Ae liquid ejection unit ejects ink onto paper. Ae control board controls the operation of the liquid ejection unit. Ae head housing covers and houses the control board inside thereof. Ae liquid supply path supplies ink to the liquid ejection head. Ae main body housing covers and houses a portion of the liquid ejection head except for the liquid ejection unit. A fan causes air to flow between the main body housing and the head housing. The liquid supply path is inserted from the outside to the inside of the main body housing in the vicinity of the liquid ejection head, and is connected to the liquid ejection head.

7 Claims, 8 Drawing Sheets

LIQUID EJECTION APPARATUS AND INKJET RECORDING APPARATUS CAPABLE OF COOLING A CONTROL BOARD OF A LIQUID EJECTION HEAD WITHOUT COOLING A LIQUID SUPPLY PATH

INCORPORATION BY REFERENCE

This application is based on and claims the benefit of priority from Japanese Patent Application No. 2019-217780 filed on Dec. 2, 2019, the contents of which are hereby incorporated by reference.

BACKGROUND

The present disclosure relates to a liquid ejection apparatus and an inkjet recording apparatus.

The liquid ejection apparatus mounted on the inkjet recording apparatus has a liquid ejection head that ejects ink (liquid) onto a recording medium such as paper. The liquid ejection head may include a control board that controls the operation associated with the ejection of the liquid. Then, in order to obtain a specified performance in the liquid ejection head, cooling of the control board is required.

For example, an inkjet apparatus disclosed in a typical technique includes a circuit board having a drive circuit for driving a head, a heat dissipating plate that dissipates heat generated in the circuit board, and a fan that generates an air flow capable of cooling the heat dissipating plate. As a result, the heat generated in the drive circuit can be dissipated via the heat dissipating plate. Furthermore, the heat dissipating plate may be cooled by the fan, and the cooling effect of the circuit board may be improved.

SUMMARY

In order to solve the problems described above, the liquid ejection apparatus according to the present disclosure includes a liquid ejection head, a liquid supply path, a main body housing, and a fan. The liquid ejection head includes a liquid ejection unit, a control board, and a head housing. The liquid ejection unit ejects a liquid onto a recording medium. The control board controls the operation of the liquid ejection unit. The head housing covers and houses the control board inside thereof. The liquid supply path supplies liquid to the liquid ejection head. The main body housing covers and houses a portion of the liquid ejection head except for the liquid ejection unit. The fan causes air to flow between the main body housing and the head housing. The liquid supply path is inserted from the outside to the inside of the main body housing in the vicinity of the liquid ejection head, and is connected to the liquid ejection head.

DETAILED DESCRIPTION

Hereinafter, embodiments according to the present disclosure will be described with reference to the drawings. Note that the technique according to the present disclosure is not limited to the following contents.

Figure 1:
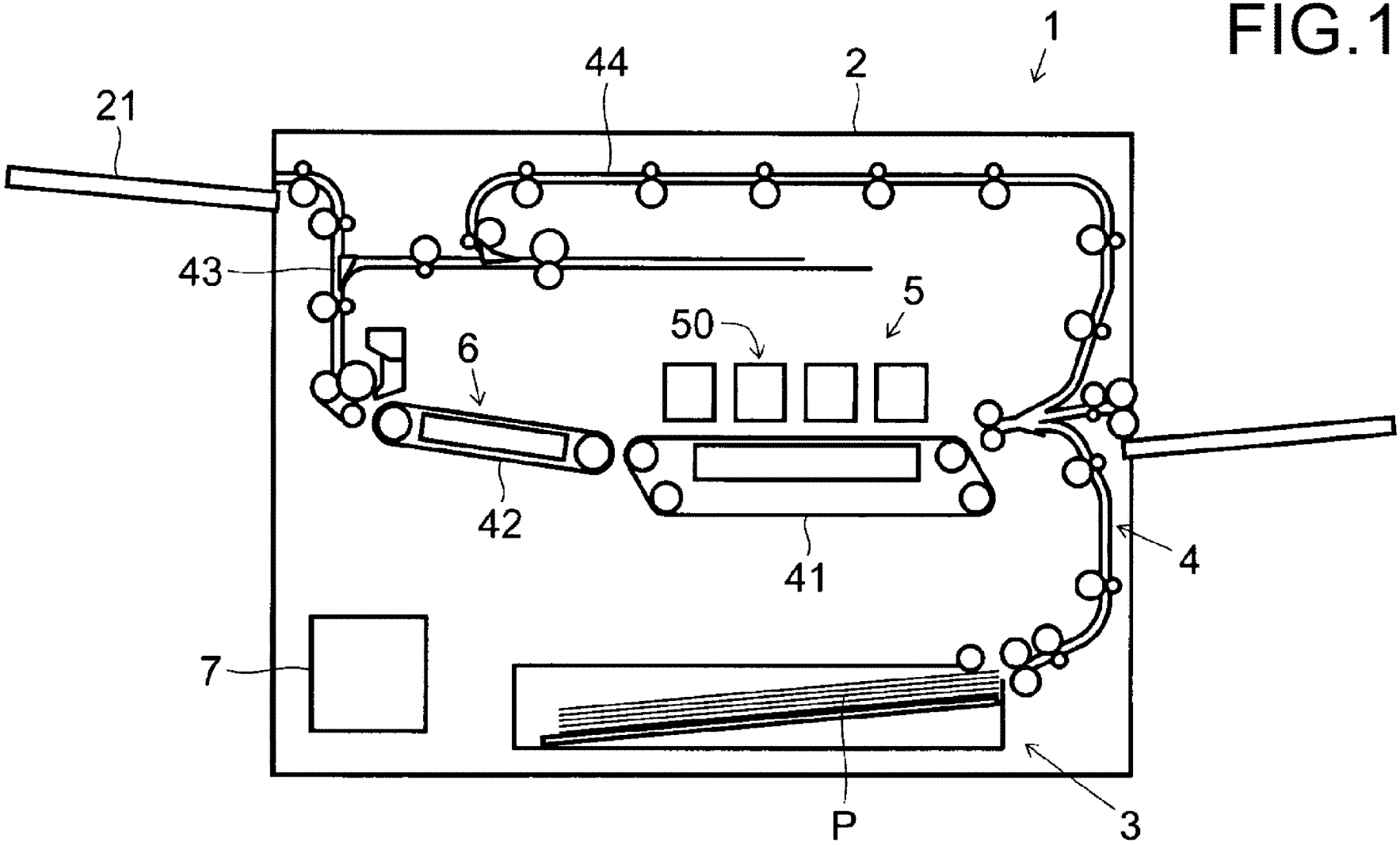
FIG. 1 is a cross-sectional view illustrating a schematic configuration of an inkjet recording apparatus of an embodiment according to the present disclosure.
Figure 2:
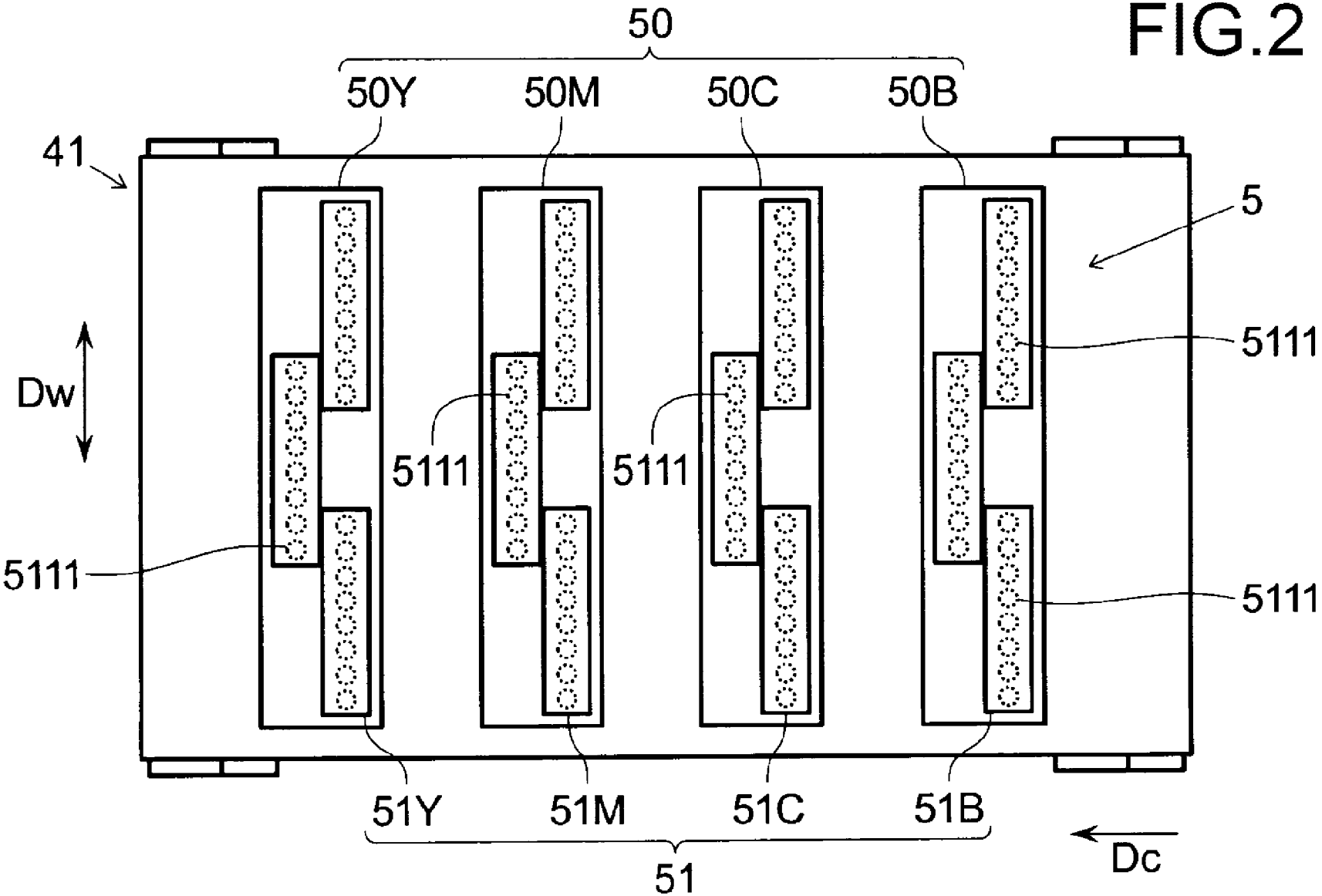
FIG. 2 is a plan view of a recording unit of the inkjet recording apparatus of FIG. 1.
Figure 3:
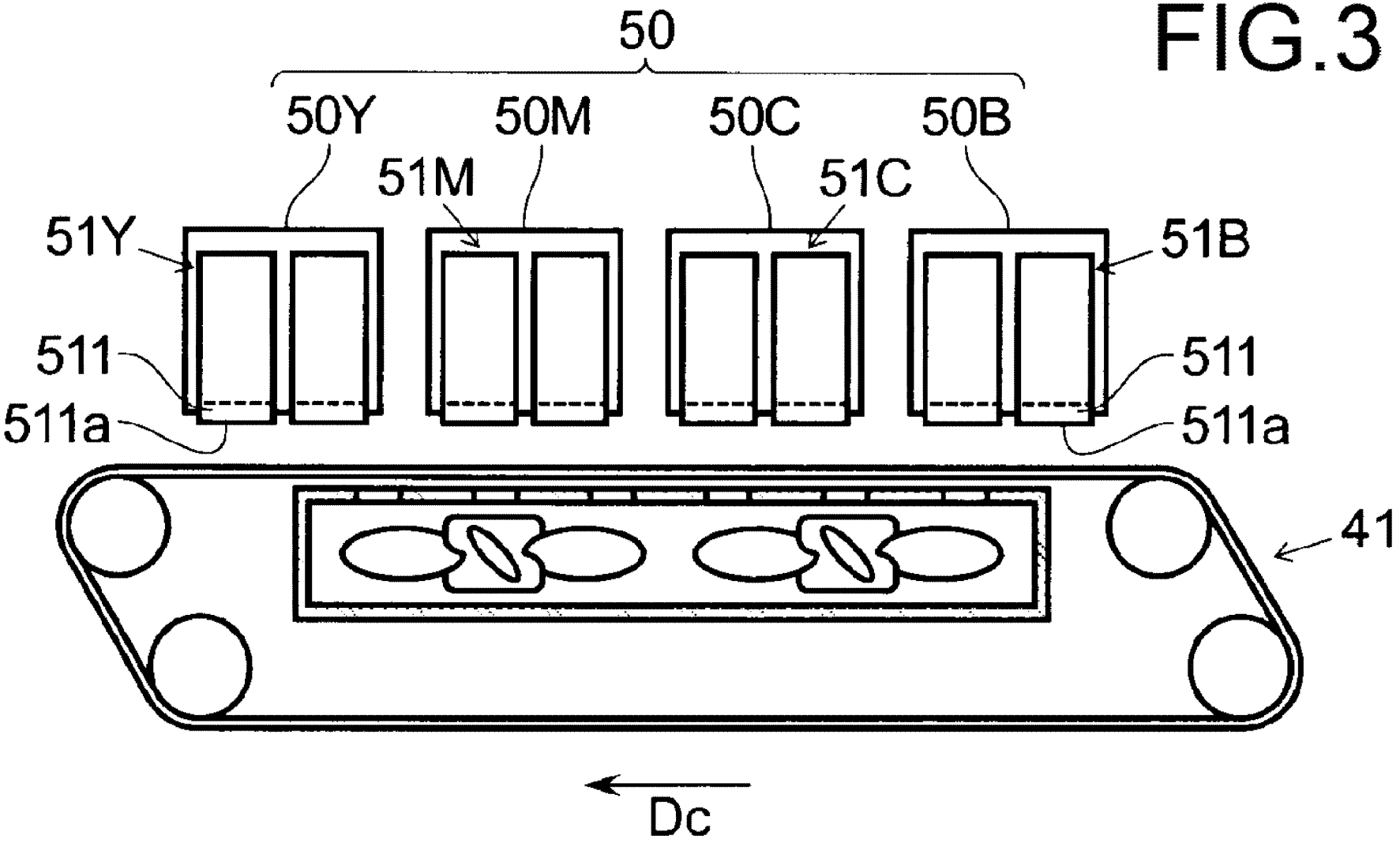
FIG. 3 is a schematic configuration diagram illustrating the periphery of the recording unit of the inkjet recording apparatus of FIG. 1

FIG. 1 is a cross-sectional view illustrating a schematic configuration of an inkjet recording apparatus of an embodiment. FIG. 2 is a plan view of a recording unit 5 of the inkjet recording apparatus 1 of FIG. 1. FIG. 3 is a schematic configuration diagram illustrating the periphery of the recording unit 5 of the inkjet recording apparatus 1 of FIG. 1 The inkjet recording apparatus 1 is, for example, an inkjet recording type printer. As illustrated in FIGS. 1, 2 and 3, the inkjet recording apparatus 1 includes a paper supply unit 3, a paper conveying unit 4, a recording unit 5, a drying unit 6, and an overall control unit 7.

The paper supply unit 3 accommodates a plurality of papers (recording medium) P, and separates and feeds out the papers P one paper at a time during recording. The paper conveying unit 4 conveys the paper P fed from the paper supply unit 3 to the recording unit 5 and the drying unit 6, and further discharges the paper P after recording and drying to a paper discharge unit 21. When double-sided recording is performed, the paper conveying unit 4 distributes the paper P after recording and drying on the first side to a reverse conveying unit 44 by a branching unit 43, and further switches the conveying direction, to reverse the front and back of the paper P, and conveys the paper P to the recording unit 5 and the drying unit 6 again.

The paper conveying unit 4 has a first belt conveying unit 41 and a second belt conveying unit 42. The first belt conveying unit 41 and the second belt conveying unit 42 attract and hold the paper P on the upper surface of the continuous belt and convey the paper P.

The recording unit 5 faces the paper P that is attracted and held on the upper surface of the first belt transport unit 41 and conveyed, and is arranged above the first belt conveying unit 41 at specific spacing. The recording unit 5 has a liquid ejection apparatus 50 provided with line-type inkjet liquid ejection heads 51. As illustrated in FIG. 2, the liquid ejection apparatus 50 includes liquid ejection apparatuses 50B, 50C, 50M, and 50Y corresponding to each of the four colors of black, cyan, magenta, and yellow, respectively. Similarly, the liquid ejection head 51 includes liquid ejection heads 51B, 51C, 51M, and 51Y corresponding to each of the four colors of black, cyan, magenta, and yellow, respectively.

As illustrated in FIG. 3, the liquid ejection head 51 has liquid ejection units 511 on the bottom portion. The liquid ejection units 511 are arranged along the paper width direction Dw, and are able to eject ink (liquid) onto the entire recording area of the paper P. The recording unit 5 sequentially ejects ink from the four-color liquid ejection heads 51B, 51C, 51M, and 51Y toward the paper P conveyed by the first belt conveying unit 41, and records a full-color image or a monochrome image on the paper P.

The drying unit 6 is arranged on the downstream side in the paper conveying direction of the recording unit 5, and a second belt conveying unit 42 is provided. The paper P on which the ink image is recorded by the recording unit 5 is attracted to and held by the second belt conveying unit 42 in the drying unit 6, and while being conveyed, the ink is dried.

The overall control unit 7 includes a CPU, a storage unit, other electronic circuits, and electronic components. The CPU performs processing related to the function of the inkjet recording apparatus 1 by controlling the operation of each component provided in the inkjet recording apparatus 1 based on a control program and data stored in the storage unit. Each of the paper supply unit 3, the paper conveying unit 4, the recording unit 5, and the drying unit 6 receives individual commands from the overall control unit 7 and perform recording on the paper P in conjunction with each other. The storage unit is composed, for example, of a combination of a non-volatile storage device such as a program ROM (Read Only Memory), a data ROM, and the like, and a volatile storage device such as a RAM (Random Access Memory).

Figure 4:
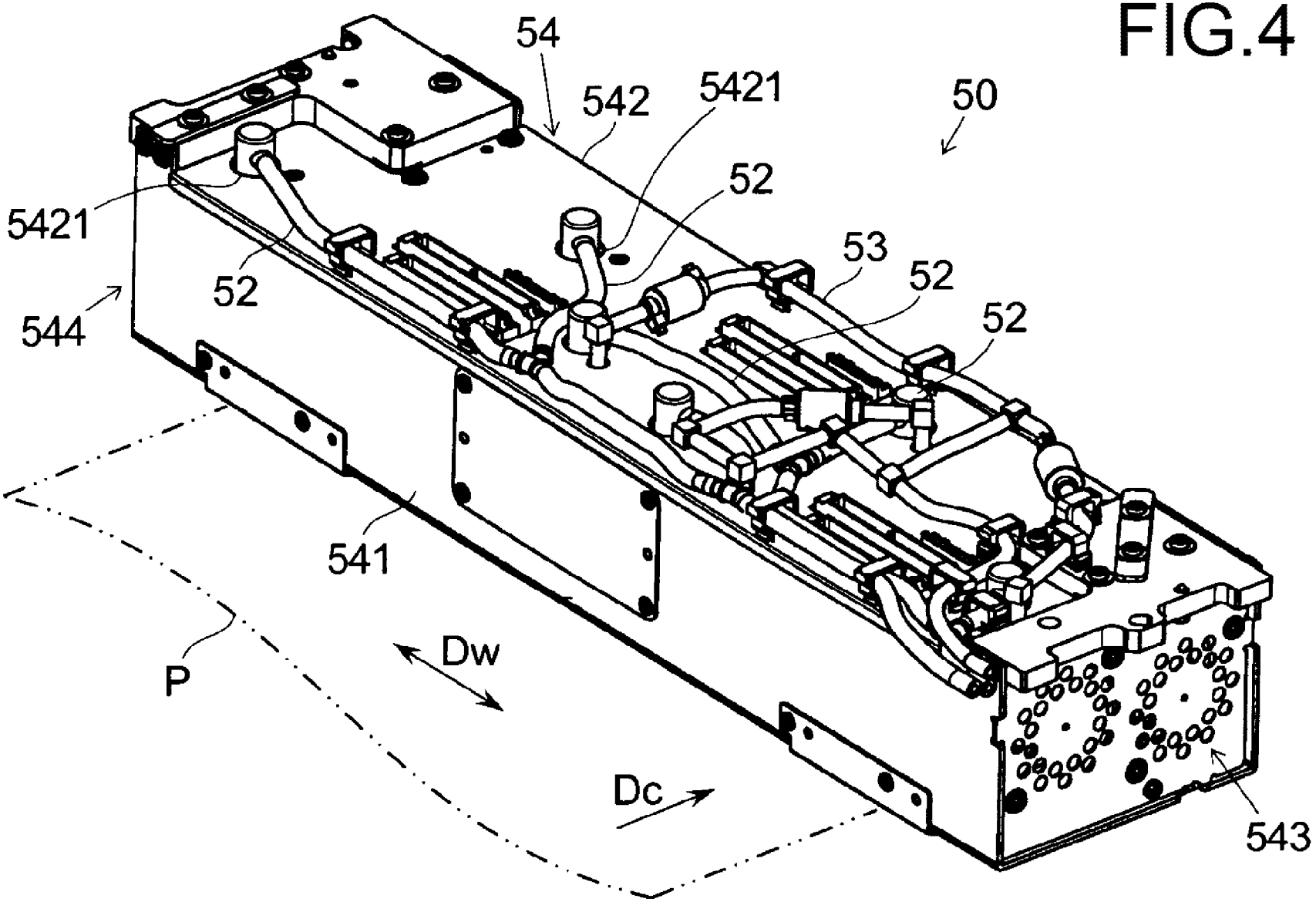
FIG. 4 is a perspective view of a liquid ejection apparatus of the recording unit of FIG. 3 as viewed from above.
Figure 5:
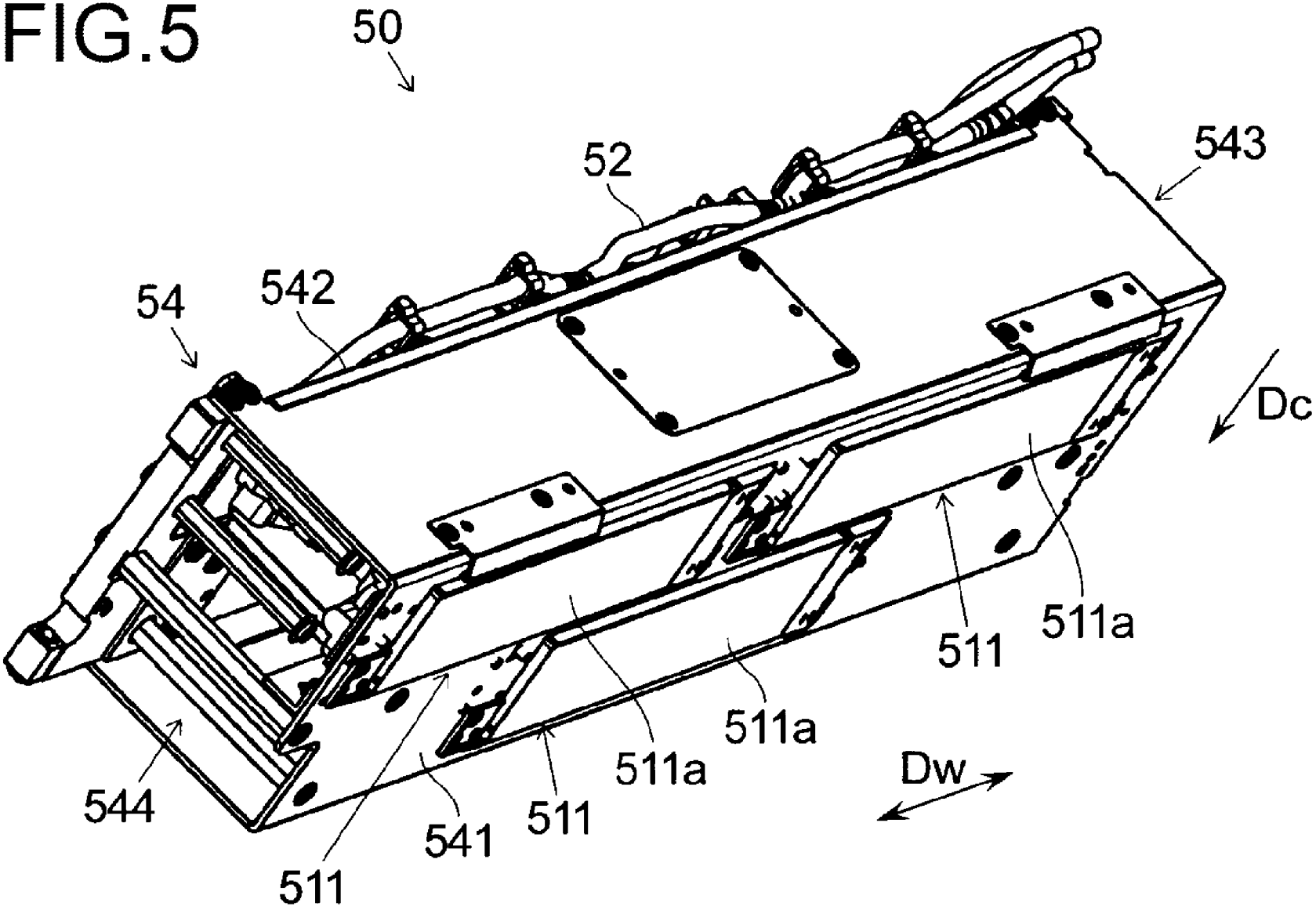
FIG. 5 is a perspective view of the liquid ejection apparatus of the recording unit of FIG. 3 as viewed from below.
Figure 6:
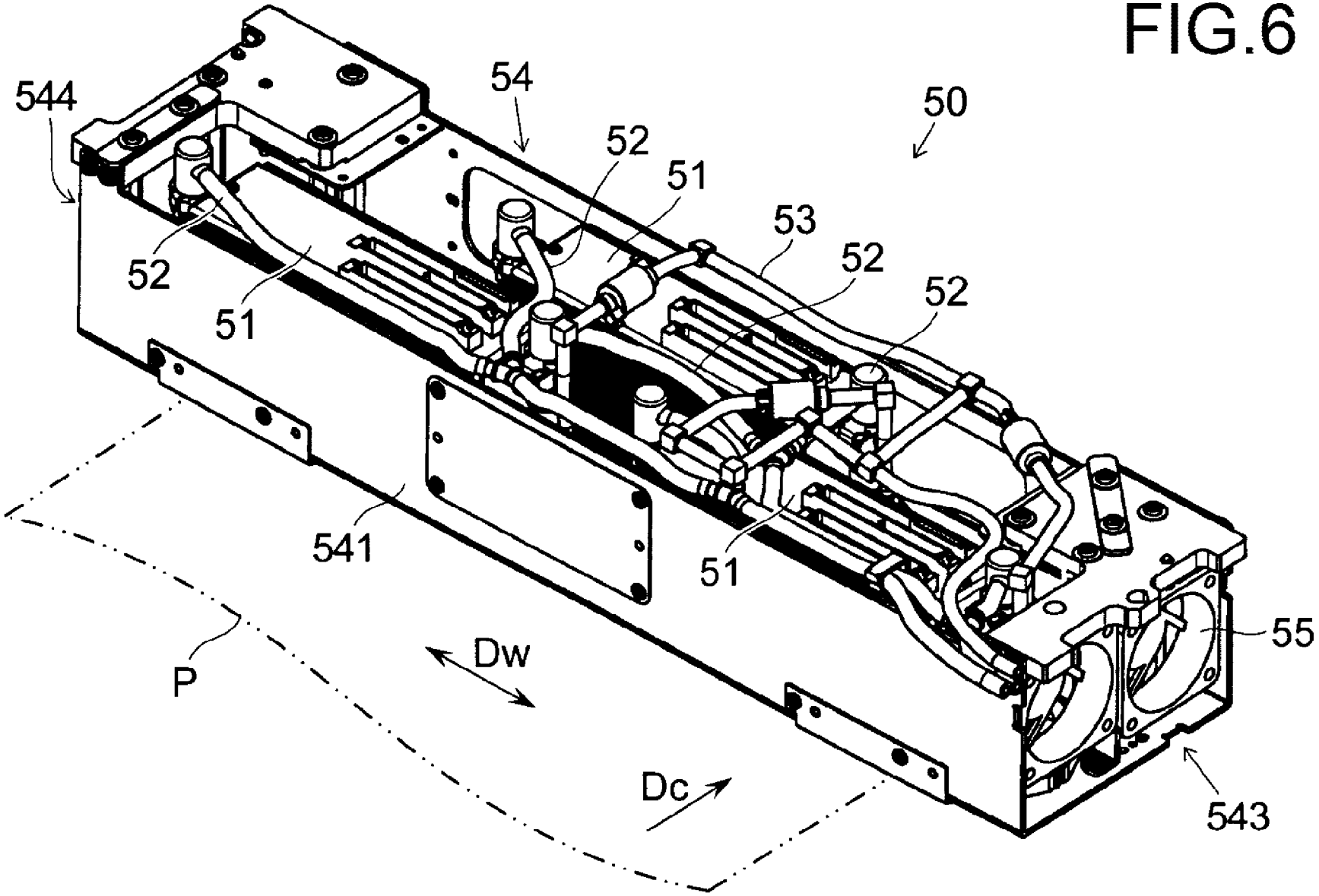
FIG. 6 is a perspective view of the liquid ejection apparatus of FIG. 4, and illustrates a state in which the upper lid is removed.
Figure 7:
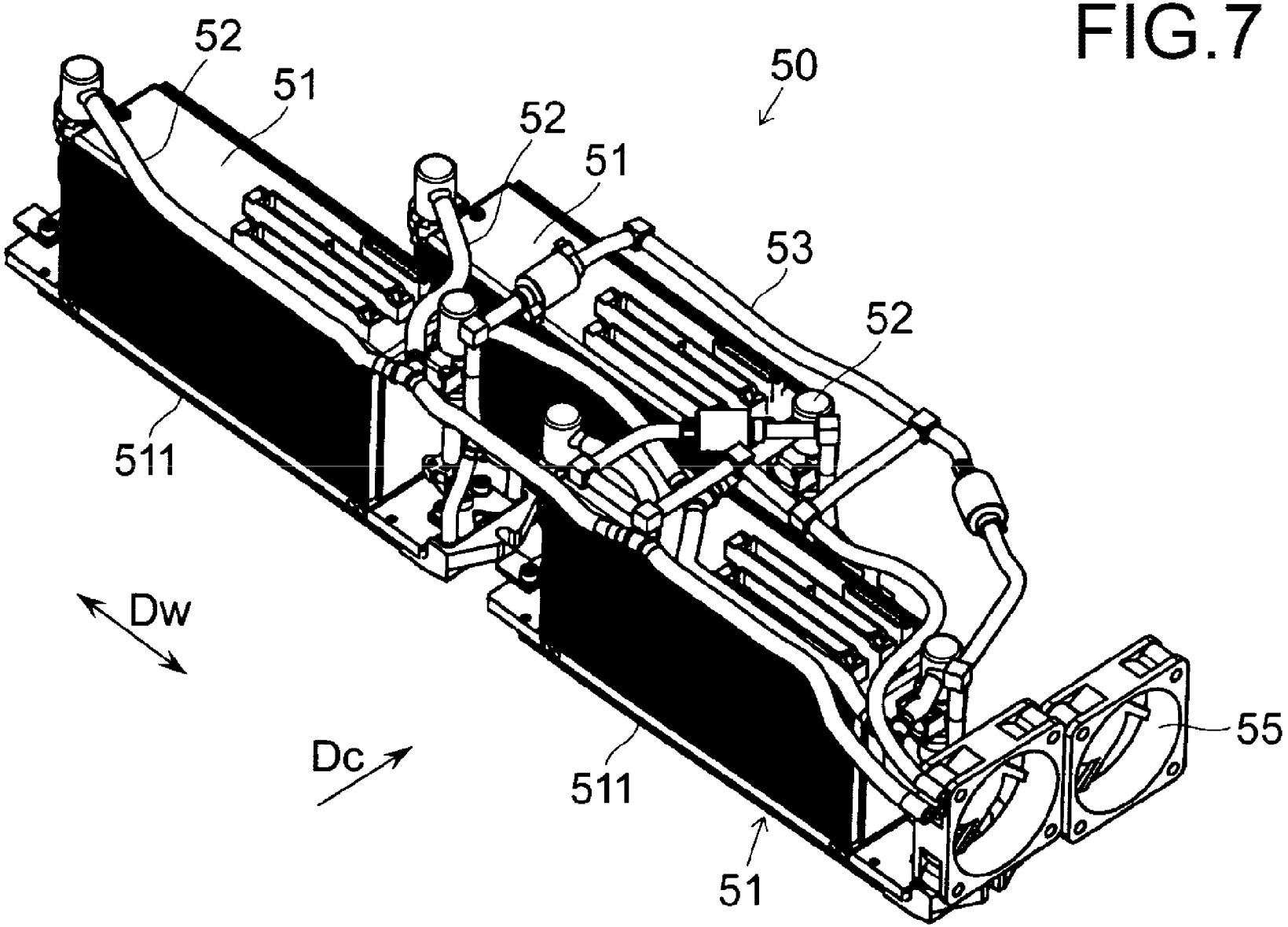
FIG. 7 is a perspective view of the liquid ejection apparatus of FIG. 4, and illustrates a state in which the main body housing is removed.
Figure 8:
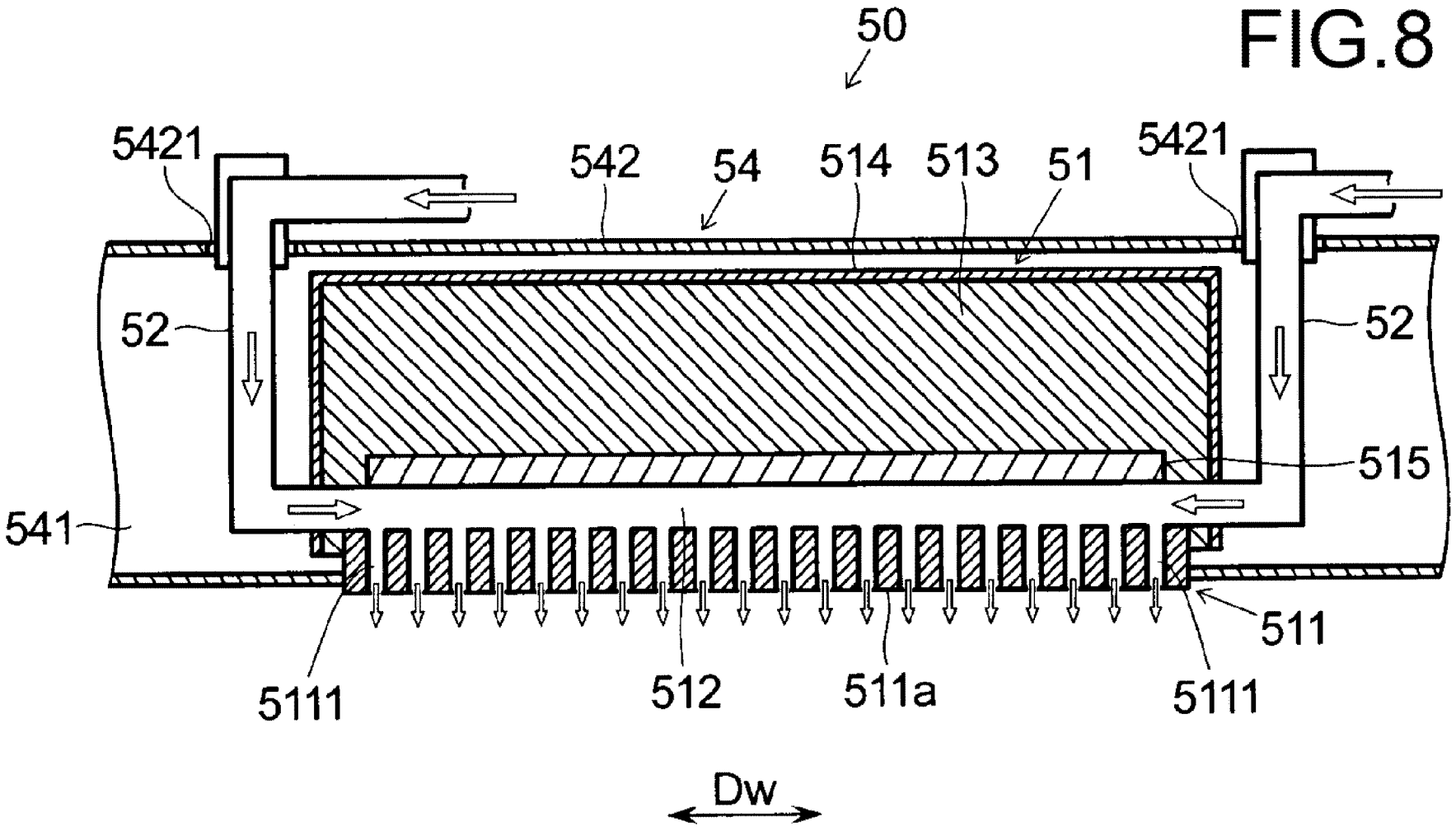
FIG. 8 is a vertical cross-sectional view of the liquid ejection head of the liquid ejection apparatus of FIG. 7 as viewed from the paper conveying direction.

Next, the configuration of the liquid ejection apparatuses 50 of the inkjet recording apparatus 1 will be described with reference to FIGS. 4, 5, 6, 7, and 8 in addition to FIGS. 2 and 3. FIG. 4 is a perspective view of a liquid ejection apparatus 50 of the recording unit 5 of FIG. 3 as viewed from above. FIG. 5 is a perspective view of the liquid ejection apparatus 50 of the recording unit 5 of FIG. 3 as viewed from below. FIG. 6 is a perspective view of the liquid ejection apparatus 50 of FIG. 4, and illustrates a state in which the upper lid 542 is removed. FIG. 7 is a perspective view of the liquid ejection apparatus 50 of FIG. 4, and illustrates a state in which the main body housing 54 is removed. FIG. 8 is a vertical cross-sectional view of a liquid ejection head 51 of the liquid ejection apparatus 50 of FIG. 7 as viewed from the paper conveying direction Dc. The white arrows in FIG. 8 indicate the flow direction of the ink (liquid).

Note that the four-color liquid ejection apparatuses 50B, 50C, 50M, and 50Y have the same shape and the same configuration, so one of them will be used as a representative, in the description, and the identification codes representing the colors will be omitted.

The liquid ejection apparatus 50 includes a liquid ejection head 51, a liquid supply path 52, a cleaning liquid supply path 53, a main body housing 54, and a fan 55.

As illustrated in FIGS. 2, 6 and 7, a plurality (for example, three) of the liquid ejection heads 51 are provided in the main body housing 54. The three liquid ejection heads 51 are arranged, for example, in a staggered pattern along the paper width direction Dw that is orthogonal to the paper conveying direction Dc.

As illustrated in FIGS. 5 and 8, each liquid ejection head 51 has a liquid ejection unit 511, a common passage 512, a control board 513, and a head housing 514.

The liquid ejection unit 511 is arranged in the lower portion of the liquid ejection head 51. The lower surface of the liquid ejection unit 511 is an ink ejection surface 511*a* in which a plurality of ink ejection nozzles 5111 open. The ink ejection surface 511*a* faces the paper P that is attracted to and held on the upper surface of the first belt conveying unit 41 and conveyed, and is parallel to the surface of the paper P. The liquid ejection unit 511 ejects ink (liquid) onto the paper P that is attracted to and held on the upper surface of the first belt conveying unit 41 and conveyed.

The liquid ejection unit 511 includes a plurality of ink ejection nozzles 5111 and driving elements of the ink ejection nozzles 5111. The plurality of ink ejection nozzles 5111 are arranged side by side along the paper width direction Dw on the ink ejection surface 511*a*, and are able eject (spray) ink over the entire recording area.

The common passage 512 is arranged above the liquid ejection unit 511. The common passage 512 is an ink passage extending parallel to the lower surface of the liquid ejection unit 511. Both ends in the ink flow direction of the common passage 512 are connected to two liquid supply paths 52, and ink flows in the passage. The common passage 512 is connected to the upstream end in the ink flow direction of the ink ejection nozzle 5111, and supplies ink to the ink ejection nozzles 5111.

The control board 513 is arranged above the common passage 512. The control board 513 controls the operation of the liquid ejection unit 511. More specifically, the control board 513 controls the driving elements of the liquid ejection unit 511 and controls the ink ejection operation from the ink ejection nozzles 5111. The control board 513 receives a control command related to the ink ejection operation from the overall control unit 7.

The head housing 514 has, for example, a rectangular parallelepiped box shape, and covers and houses the common passage 512 and the control board 513 inside. The liquid ejection unit 511 is arranged in the lower portion of the head housing 514. The liquid ejection unit 511 is exposed to the outside on the lower surface of the head housing 514.

The downstream end in the ink flow direction of the liquid supply path 52 is connected to the common passage 512. Two liquid supply paths 52 are connected to one common passage 512 provided in one liquid ejection head 51. One liquid supply path 52 is connected to one end side of the common passage 512 in the paper width direction Dw, and the other liquid supply path 52 is connected to the other end side of the common passage 512 in the paper width direction Dw. The upstream end in the ink flow direction of the liquid supply path 52 is connected to the ink tank. The liquid supply path 52 includes, for example, tubes and a connecting member that connects a plurality of tubes. The liquid supply path 52 supplies ink (liquid) to the liquid ejection head 51.

The cleaning liquid supply path 53 is connected to the cleaning liquid supply unit at the downstream end in the cleaning liquid flow direction. The cleaning liquid supply unit is provided on one end side in the paper width direction Dw of the liquid ejection unit 511. The cleaning liquid supply unit includes a cleaning liquid supply surface adjacent to the ink ejection surface 511*a* in the paper width direction Dw, and a plurality of cleaning liquid supply openings that open on the cleaning liquid supply surface. The cleaning liquid supply openings supply the cleaning liquid to the cleaning liquid supply surface. The cleaning liquid is carried to the ink ejection surface 511*a* by a wiper and used for cleaning the ink ejection surface 511*a*.

The upstream end of the cleaning liquid supply path 53 in the cleaning liquid flow direction is connected to a cleaning liquid tank. The cleaning liquid supply path 53 includes, for example, tubes and a connecting member that connects a plurality of tubes. The cleaning liquid supply path 53 supplies the cleaning liquid to the cleaning liquid supply unit of the liquid ejection head 51.

The main body housing 54 has a tubular shape having a rectangular cross section when viewed from the paper width direction Dw, and extends along the paper width direction Dw. The lower surface of the main body housing 54 faces and faces the paper P that is attracted and held by the upper surface of the first belt conveying unit 41 and is conveyed, and is parallel to the surface of the paper P.

The main body housing 54 includes a gutter-shaped member 541 in which the upper end and both ends in the paper width direction Dw open, and an upper lid 542 that closes the opening in the upper end of the gutter-shaped member 541. In addition, the main body housing 54 has an intake opening 543 arranged at one end in the paper width direction Dw and an exhaust opening 544 arranged at the other end in the paper width direction Dw.

The main body housing 54 houses and holds three liquid ejection heads 51 inside thereof. Note that each of the liquid ejection units 511 of the three liquid ejection heads 51 is exposed to the outside on the lower surface of the main body housing 54. In other words, more specifically, the main body housing 54 covers and houses the portions of the liquid ejection heads 51 other than the liquid ejection units 511 inside thereof.

The fan 55 is arranged in the intake opening 543 of the main body housing 54. For example, two fans 55 are arranged next to each other along the paper conveying direction Dc. The fan 55 sucks in the air outside the main body housing 54 and feeds the air into the main body housing 54. Furthermore, the fan 55 causes air to flow between the main body housing 54 and the head housing 514. As a result, the control board 513 of the liquid ejection head 51 may be cooled via the head housing 514.

The upper lid 542 of the main body housing 54 is formed in a flat plate shape and has a plurality of through holes 5421. The through holes 5421 penetrate through the upper lid 542 in the vertical direction. The through holes 5421 are arranged in the vicinity of the liquid ejection heads 51 housed inside the main body housing 54.

The liquid supply path 52 and the cleaning liquid supply path 53 are inserted into the main body housing 54 from the outside of the main body housing 54 through the through holes 5421 and connected to the liquid ejection head 51. In other words, the liquid supply path 52 is inserted from the outside to the inside of the main body housing 54 in the vicinity of the liquid ejection head 51, and is connected to the liquid ejection head 51.

With the configuration described above, most of the liquid supply path 52 is arranged outside the main body housing 54 except for the vicinity of the connection location with the liquid ejection head 51. As a result, the liquid supply path 52 may be kept as much as possible out of contact with the air flow generated by the operation of the fan 55. Therefore, it is possible to cool the control board 513 of the liquid ejection head 51 without cooling the liquid supply path 52. In other words, it is possible to perform proper temperature control of the ink and achieve high-quality recording.

In order that the length of the liquid supply path 52 arranged inside the main body housing 54 is short, the liquid supply path 52 is drawn out of the main body housing 54 from the outer wall of the main body housing 54 in a direction orthogonal to the paper width direction Dw, which is the direction in which the air flow path extends. In this embodiment, the liquid supply path 52 is drawn from the upper lid 542, which is one such outer wall. In a case where the liquid supply path 52 is drawn out from the upper lid 542, the through hole 5421 is arranged directly above the connection location between the liquid supply path 52 and the liquid ejection head 51, and when a straight liquid supply path 52 connecting them is arranged, the length of the liquid supply path 52 arranged inside the main body housing 54 becomes the shortest. Directly above is a direction orthogonal to the paper width direction Dw and the paper conveying direction Dc.

A case is presumed in which the liquid supply path 52 is drawn out from a certain outer wall of the main body housing 54, the length of the liquid supply path 52 in the main body housing 54 required for drawing the liquid supply path 52 from that outer wall so as to be the shortest length as described above is taken to be L. The liquid supply path 52 is inserted from the outside to the inside of the main body housing 54 in the vicinity of the liquid ejection head 51, so the length of the liquid supply path 52 in the main body housing 54 is 1.5 times or less than the length L described above. The length of the liquid supply path 52 in the main body housing 54 may be 1.3 times or less, or 1.1 times or less the length L described above.

Moreover, the length of the liquid supply path 52 in the main body housing 54 may be one-fifth or less or one-tenth or less of the length of the path for supplying the liquid to the liquid injection head 51 by liquid supply path 52. The length of the path of the liquid supply path 52 referred to here is, specifically, the length up to the connection point with the ink tank extending upstream of the liquid supply path 52 from the connection point with the liquid injection head 51 connected to the liquid supply path 52 in the main body housing 54 considered as the target is connected.

As illustrated in FIG. 8, the control board 513 is arranged adjacent to the inner surface of the head housing 514. With this configuration, the heat of the control board 513 is transferred to the head housing 514 and easily dissipated to the outside of the head housing 514. Therefore, it is possible to enhance the effect of cooling the control board 513 via the head housing 514.

As illustrated in FIGS. 4, 5 and 6, the intake opening 543 is arranged at one end of the main body housing 54 in the paper width direction Dw. The exhaust opening 544 is arranged at the other end of the main body housing 54 on the opposite side from the intake opening 543 in the paper width direction Dw and so as to face the intake opening 543. As described above, the main body housing 54 has a tubular shape extending along the paper width direction Dw. As a result, the air flow path due to operation the fan 55 extends linearly from the intake opening 543 to the exhaust opening 544 in the main body housing 54.

With this configuration, the air flow generated by the operation of the fan 55 can be smoothly circulated in the main body housing 54. Therefore, the cold air can be made to constantly hit the control board 513, and the control board 513 can be effectively cooled.

Furthermore, as illustrated in FIGS. 4, 5 and 6, the air flow path due to the operation of the fan 55 extends in the paper width direction Dw orthogonal to the transport direction Dc of the paper P on which the ink is ejected by the liquid ejection head 51. With this configuration, the area occupied by the air flow path may be made as small as possible so that air can flow smoothly. As a result, it is possible to reduce the size of the liquid ejection apparatus 50.

In addition, as illustrated in FIGS. 4 and 6, the intake opening 543 is one end of the main body housing 54 in the paper width direction (lower right in FIGS. 4 and 6), and is arranged on the outside in the paper width direction Dw with respect region facing the paper P. The exhaust opening 544 is the other end of the main body housing 54 in the paper width direction Dw (upper left in FIGS. 4 and 6), and is arranged outside the paper width direction Dw with respect to the area facing the paper P. In other words, the intake opening 543 and the exhaust opening 544 are arranged outside in the paper width direction Dw of the main body housing 54 with respect to the region facing the paper P.

With this configuration, the air flow generated by the operation of the fan 55 can be prevented from affecting the ink ejection from the ink ejection nozzles 5111. As a result, it is possible to suppress the misalignment of the ink landing, and it is possible to achieve high-quality recording.

Moreover, the liquid ejection head 51 includes a heater 515 as illustrated in FIG. 8. The heater 515 is arranged in the vicinity of the liquid ejection unit 511. More specifically, the heater 515 is arranged above the liquid ejection unit 511 and adjacent to the top of the common passage 512. The heater 515 heats the liquid ejection unit 511.

With this configuration, the temperature of the ink ejection nozzles 5111 may be prevented from dropping too much due to the air flow generated by the operation of the fan 55. In other words, it is possible to perform proper control of the temperature of the ink ejection nozzles 5111, and the ink viscosity can be suppressed from rising or falling too much. As a result, the liquid ejection apparatus 50 is capable of suitably ejecting (spraying) ink onto the paper P, and high-quality recording may be achieved.

In addition, with the embodiment described above, the inkjet recording apparatus 1 uses the liquid ejection apparatus 50 having the above configuration to record an image by ejecting ink onto the paper P. As a result, in the inkjet recording apparatus 1, it is possible to cool the control board 513 of the liquid ejection head 51 without cooling the liquid supply path 52 through which the ink flows. Therefore, in the inkjet recording apparatus 1, it is possible to perform proper control of the temperature of the ink, and high-quality recording may be achieved.

Although embodiments according to the present disclosure have been described above, the scope of the technique according to the present disclosure is not limited to this, and various modifications can be made without departing from the gist of the disclosure.

In the typical technique described above, in regard to the ink (liquid), the viscosity increases as the temperature decreases, and the pressure loss increases in the supply path. As a result, there is a risk that the amount of ink ejected will decrease. In other words, it is necessary to cool the control board; however, when the ink supply path is also cooled at the same time, there is a problem in that the amount of ink ejected decreases.

With the configuration described above, most of the liquid supply path is arranged outside the main body housing except for the vicinity of the connection location with the liquid ejection head. As a result, the liquid supply path may be kept as much as possible out of contact with the air flow generated by the operation of the fan. Therefore, it is possible to cool the control board of the liquid ejection head without cooling the liquid supply path.

The technique according to the present disclosure may be applied to liquid ejection apparatuses and inkjet recording apparatuses.

What is claimed is:

1. A liquid ejection apparatus, comprising:

a liquid ejection head having a liquid ejection unit that ejects liquid onto a recording medium, a control board that controls operation of the liquid ejection unit, and a head housing that covers and houses the control board inside thereof, a liquid supply path for supplying the liquid to the liquid ejection head;

a main body housing that covers and houses the liquid ejection head except for the liquid ejection unit; and a fan for causing air to flow between the main body housing and the head housing; wherein the liquid supply path is inserted from the outside to the inside of the main body housing in the vicinity of the liquid ejection head and is connected to the liquid ejection head.

2. The liquid ejection apparatus according to claim 1, wherein the control board is arranged adjacent to an inner surface of the head housing.

3. The liquid ejection apparatus according to claim 1, wherein the liquid ejection head includes a heater arranged in a vicinity of the liquid ejection unit and heats the liquid ejection unit.

4. The liquid ejection apparatus according to claim 1, wherein the main body housing comprises:

an intake opening arranged at one end of the main body housing;

an exhaust opening arranged facing the intake opening at the other end of the main body housing on the opposite side of the intake opening; wherein the air flow path due to the operation of the fan extends linearly from the intake opening to the exhaust opening in the main body housing.

5. The liquid ejection apparatus according to claim 4, wherein the air flow path extends in a width direction orthogonal to a conveying direction of the recording medium on which the liquid is ejected by the liquid ejection head.

6. The liquid ejection apparatus according to claim 5, wherein the intake opening and the exhaust opening are arranged outside the main body housing in the width direction with respect to a region facing the recording medium.

7. An inkjet recording apparatus that records an image by ejecting ink onto the recording medium using the liquid ejection apparatus according to claim 1.

* * * * *